US008127851B2

(12) United States Patent
Misselbrook

(10) Patent No.: US 8,127,851 B2
(45) Date of Patent: Mar. 6, 2012

(54) MILL AND METHOD FOR DRILLING COMPOSITE BRIDGE PLUGS

(75) Inventor: John Gordon Misselbrook, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 128 days.

(21) Appl. No.: 12/015,949

(22) Filed: Jan. 17, 2008

(65) Prior Publication Data

US 2008/0173453 A1 Jul. 24, 2008

Related U.S. Application Data

(60) Provisional application No. 60/881,093, filed on Jan. 18, 2007.

(51) Int. Cl.
*E21B 21/00* (2006.01)

(52) U.S. Cl. ..... 166/311; 166/70; 166/376

(58) Field of Classification Search ..... 166/164, 166/376, 311, 70, 57; 175/92
See application file for complete search history.

(56) References Cited

U.S. PATENT DOCUMENTS

| | | | | |
|---|---|---|---|---|
| 3,112,803 | A * | 12/1963 | Rowley | 175/393 |
| 4,784,226 | A * | 11/1988 | Wyatt | 166/376 |
| 4,928,762 | A | 5/1990 | Mamke | 166/192 |
| 5,289,876 | A | 3/1994 | Graham | 166/276 |
| 6,170,576 | B1 * | 1/2001 | Brunnert et al. | 166/298 |
| 6,202,752 | B1 | 3/2001 | Kuck et al. | 166/298 |
| 6,302,223 | B1 * | 10/2001 | Sinor | 175/393 |
| 2005/0061551 | A1 * | 3/2005 | DeGeare et al. | 175/320 |
| 2007/0023188 | A1 * | 2/2007 | Roberts et al. | 166/298 |
| 2007/0119600 | A1 * | 5/2007 | Slup et al. | 166/387 |

OTHER PUBLICATIONS

International Search Report and Written Opinion dated Jul. 1, 2008, for PCT Application No. PCT/US2008/051315, filed Jan. 17, 2008.
Written Opinion of the International Preliminary Examining Authority dated Feb. 23, 2011 issued in corresponding application No. PCT/US08/51315.

* cited by examiner

*Primary Examiner* — Thomas Beach
*Assistant Examiner* — James Sayre
(74) *Attorney, Agent, or Firm* — Parsons Behle & Latimer

(57) ABSTRACT

A system used to remove multiple isolation plugs from a wellbore. The system is efficient in fluidizing and circulating proppant located below an upper plug resting on top of proppant settled above a lower plug. The system uses a central port of the mill that is in communication with coiled tubing to fluidize and circulate the proppant around the perimeter of the upper plug. Once the proppant has been circulated from underneath the upper plug, the upper plug may mate and rotationally lock with a lower plug set within the wellbore. Upon locking, the system is able to rapidly mill out the upper plug and the lower plug until the lower plug is no longer set within the wellbore. The system provides for the rapid removal of multiple plugs positioned within a wellbore where an amount of proppant is present between the plugs.

18 Claims, 4 Drawing Sheets

MILL AND METHOD FOR DRILLING COMPOSITE BRIDGE PLUGS

PRIORITY

This application claims the benefit of U.S. Provisional Application No. 60/881,093, filed on Jan. 18, 2007, entitled "IMPROVED MILL FOR DRILLING COMPOSITE BRIDGE PLUGS," which is hereby incorporated by reference in its entirety.

BACKGROUND OF THE INVENTION

1. Field of the Invention

The present invention generally relates to a system that may be used to remove multiple plugs from a wellbore. Specifically, the system of the present disclosure is efficient in fluidizing and circulating proppant located below a portion of an upper plug that rests on a proppant that has settled on top of a lower plug. The proppant causes the partially milled upper plug to spin within the wellbore as the mill turns. The system uses a central port in a mill to fluidize and circulate the settled proppant around the perimeter of the upper plug until the upper plug is able to mate and rotationally lock with a lower plug set within the wellbore. Upon locking, the system is able to rapidly mill out the remaining portion of the upper plug and mill out the lower plug until the lower plug is no longer set and drops down the wellbore. The mill of the disclosed system is adapted to jet fluid through a central opening of a portion of the upper plug to fluidize and circulate the proppant from beneath the partially milled upper plug. The system provides for the rapid removal of multiple plugs positioned within a wellbore wherein proppant is present between the plugs. Having the benefit of this disclosure, one of ordinary skill in the art will appreciate that the disclosed invention may be used to remove various types of plugs used to hydraulically isolate a zone within a wellbore in addition to bridge plugs referenced below.

2. Description of the Related Art

Perforating and fracturing a well is common practice in the oil and gas industry in an effort to stimulate the well and increase the production of hydrocarbons. After the casing in a zone of interest has been perforated, the zone of interest typically needs to be hydraulically isolated from lower zones before the zone is fractured. Typically, a zone is isolated by the insertion and setting of a plug, hereinafter referred to as a bridge plug, below the zone of interest. The purpose of the bridge plug is simply to hydraulically isolate that portion of the well from a lower portion (or the rest) of the well. The isolation of the zone limits high pressure fracturing fluid pumped into the well to the zone of interest. The high pressure fracturing fluid is used to fracture the formation at the perforations through the casing. The high pressure of the fracturing fluid propagates a fracture in the formation, which may increase the production of hydrocarbons from that zone of the wellbore. Fracturing fluid typically contains a proppant that aids in holding the fractures open after the fracturing process has been completed.

In many situations, the process of perforating the casing and isolating the zone of interest is repeated at multiple locations. A bridge plug is typically set within the wellbore to define the lower portion of each zone that is to be stimulated. At the conclusion of the perforating and fracturing procedure, each of the bridge plugs set within the wellbore may need to be milled out. In an attempt to reduce the overall time required to mill out the bridge plugs, there have been many improvements made to the design of bridge plugs in an effort to make the plugs easier to mill out.

For example, the material of the bridge plug can affect the milling time needed to remove the bridge plug from the wellbore. Bridge plugs used to be comprised of a material such as cast iron, which is a brittle metal, but is not easy to drill through using a milling assembly run on coiled tubing. Coiled tubing does not provide as much of a set down weight as prior milling assemblies that used jointed pipes. As a result, bridge plugs are now often comprised of generally softer, nonmetallic components so that they can be drilled quickly. Composite bridge plugs are now widely used and help to decrease the mill out time. The composite bridge plugs also make it easier to circulate bridge plug particles out of the wellbore than the prior cast iron bridge plugs.

Another potential problem with past drillable bridge plugs is the rotation of the bridge plug or the rotation of components within the bridge plug. Rotation of the bridge plug increases the mill-out time as would be appreciated by one of ordinary skill in the art. As a result the bridge plugs often include some sort of locking mechanism to prevent the rotation of components. Further, the anchoring assembly of the bridge plug helps to prevent the rotation within the wellbore. An anchoring assembly typically includes a plurality of slips and a cone, as well as an elastomeric packing element. However, once the mill has milled out the lower slips of the anchoring assembly, the remainder of the plug falls down the wellbore landing on top of the next bridge plug.

In the past, the remainder of a bridge plug located on the top of lower bridge plug presented another potential problem. Specifically, the partially milled out plug was able to rotate (i.e., spin) on top of the set plug, which again increased the milling time. Present bridge plugs have been designed to prevent such rotation. The lower portion of a bridge plug often includes a profile that is adapted to engage a corresponding profile on the upper portion of a bridge plug. When the lower portion of a bridge plug lands on a set bridge plug the upper bridge plug rotates until the two profiles engage creating a rotational lock between plugs. The rotational lock between the two bridge plugs decreases the required milling time. The mill will mill out the remaining portion of the upper plug and begin milling out the lower plug until the slips of the lower plug have been milled out. At this point, the lower plug will drop down the wellbore to the next bridge plug and the process is repeated until all of the bridge plugs have been removed from the wellbore.

Despite the above discussed improvements to bridge plugs, the milling time required to mill-out bridge plugs can vary greatly, especially for bridge plugs positioned below the most upper plug. As discussed above, the fracturing fluid pumped into the zone of interest often contains proppant. As a result a large amount of proppant may remain within the wellbore between two set bridge plugs. The amount of proppant present within the wellbore may vary depending on various factors such as the length of the perforated zone, the amount of under displacement or over displacement in the zone, the concentration of proppant in the fracturing fluid, or the amount of flow back used during the fracturing procedure. The presence of proppant within a zone may prevent the portion of an upper bridge plug from falling directly on top of a lower plug. Instead, the upper bridge plug may rest on proppant between the two plugs.

The proppant may prevent the profiles on the plugs from engaging and creating a rotational lock. Thus, the upper bridge plug is free to rotate on top of the proppant increasing the milling time required to mill out the plug. Mills used to remove a bridge plug from the wellbore, such as four or five bladed junk mills, usually include wash ports. Current designs of mills are concerned with effectively cutting through a set bridge plug and circulating the cuttings to the surface, but are not designed to fluidize and remove proppant located below a partially milled out bridge plug. The circulation of fluid from the mill wash ports in combination with the rotation of the upper bridge plug does seem to gradually remove the proppant from between the two plugs, but conventional milling blades are not efficient in removing the proppant from below a partially milled out bridge plug. This inefficiency may be due to the small amount of clearance between the bridge plug and the casing in combination with the location of wash ports being located around the perimeter of conventional mills. When a large amount of proppant is present it can take well over an hour for a conventional mill to cut through the remaining portion of the upper bridge plug and cut through the lower bridge plug until the slips have been removed dropping the lower bridge plug within the wellbore. This increased milling time increases the overall time and costs to remove each of the bridge plugs from the wellbore.

In light of the foregoing, it would be desirable to provide a system that provides fluid to fluidize and remove proppant from beneath at least a portion of a bridge plug. It would further be desirable to provide a wellbore mill having a central port adapted to fluidize and circulate proppant or sand from beneath a partially milled bridge plug.

The present invention is directed to overcoming, or at least reducing the effects of, one or more of the issues set forth above.

SUMMARY OF THE INVENTION

The object of the present disclosure is to provide a system that may be used to effectively fluidize proppant located below a spinning bridge plug and circulate the proppant around the perimeter of the spinning bridge plug up the wellbore. In one embodiment the system includes a mill connected to a downhole motor connected to the end of coiled tubing. The mill includes a central port and a plurality of radially displaced wash ports that are in communication with the coiled tubing. Fluid may be pumped down the coiled tubing and allowed to exit the mill through the central port and the wash ports. The central port may be adapted to jet the fluid through a central opening in a partially milled out bridge plug. The jetted fluid may fluidize proppant located below the bridge plug and may circulated the fluidized proppant around the perimeter of the bridge plug. The fluidized proppant may then be returned to the surface through the annulus between the coiled tubing and the casing.

The mill may include four or five cutting blades or surfaces. The number and configurations of the cutting blades may be varied depending on the cutting application as would be appreciated by one of ordinary skill in the art having the benefit of this disclosure. The wash ports may provide fluid to cool the cutting blades. Further, the wash ports may aid in the circulation of fluidized proppant to the surface through the annulus between the coiled tubing and the casing.

One embodiment of the present invention is a method for removing multiple plugs within a wellbore. The method includes running a mill into the wellbore on the end of coiled tubing, the mill including a central port being in fluid communication with the coiled tubing. The method further includes pumping fluid down the coiled tubing and jetting fluid from the central port. The method includes displacing proppant located below the mill until the mill engages an upper plug. The method further includes preventing rotation between the upper plug and the lower plug. The method includes milling out the upper plug and the lower plug until the lower plug is no longer set within the wellbore. The amount of fluid jetted from the central port of the mill may be varied as would be appreciated by one of ordinary skill in the art having the benefit of this disclosure. The method may further include jetting at least 17 gallons per minute through the central port of the mill to fluidize and circulate proppant settled below the portion of the upper plug.

In an alternative embodiment, the mill of the milling system may be designed to generate a reverse flow around the bridge plug to remove the proppant located below a portion of an upper plug resting on an amount of settled proppant. In this instance, the proppant is fluidized and circulated up through a central opening of the upper bridge plug. The fluidized proppant may then be returned to the surface through an annulus between the coiled tubing and the casing.

Alternatively, the configuration of the bridge plug may be adapted to improve the circulation flow currents due to the fluid jetted from the central port of the mill. The improved circulation flow currents may increase the rate at which the proppant may be removed from beneath a portion of an upper bridge plug.

Figure 1:
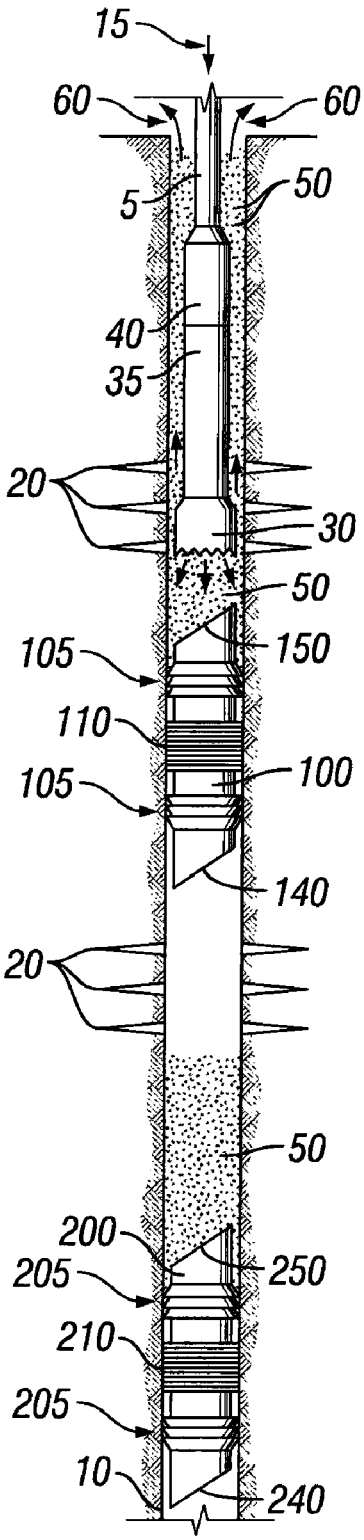
FIG. 1 shows an exemplary embodiment of a milling system efficient on removing proppant below a spinning bridge plug, the mill of FIG. 1 shown prior to the initiation of milling out the top bridge plug.

While the invention is susceptible to various modifications and alternative forms, specific embodiments and methods have been shown by way of example in the drawings and will be described in detail herein. However, it should be understood that the invention is not intended to be limited to the particular forms and methods disclosed. Rather, the intention is to cover all modification, equivalents and alternatives falling within the spirit and scope of the invention as defined by the appended claims.

DETAILED DESCRIPTION OF THE ILLUSTRATED EMBODIMENTS

Illustrative embodiments of the invention are described below as they might be employed in a system and method used to mill a bridge plug from a wellbore, the system and method being efficient in the removal of proppant located below a spinning bridge plug. In the interest of clarity, not all features of an actual implementation are described in this specification. It will of course be appreciated that in the development of any such actual embodiment, numerous implementation-specific decisions must be made in order to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows a milling system efficient in removing proppant located below a spinning bridge plug according to an exemplary embodiment of the present invention. The milling system includes a milling assembly that includes a motorhead assembly 40 connected to a downhole motor 35 that operates to rotate a mill 30. Downhole motors are well known in the art. The motorhead assembly 40 is connected to coiled tubing 5, which is used to run the milling system into the wellbore and position the mill assembly at a desired location within the casing 10. The coiled tubing 5 is also used to deliver fluid 15 to the mill 30. The fluid pumped down the coiled tubing 5 exits the mill 30 out of wash ports 45 and a central port 25 (shown in FIG. 5) located on the mill 30.

The central port 25 is used to fluidize proppant 50 located below a spinning bridge plug. In order to provide a mill having cutting structures that cover the entire cross-sectional area of the bridge plug, it is typically necessary to have some cutting structure that will extend across the exact center of mill 30. This may require that port 25 be slightly offset from the true center-line of mill 30. However, the degree of offset must be kept small enough so that fluid exiting port 25 is still directed down through central opening 120 of plug 100 (as will be discussed later). Thus, one of skill in the art will understand that a "central port" as used herein includes a port that may be slightly offset from the true center line of mill 30 so that some cutting structure may extend across the center-line of mill 30. The wash ports 45 may also provide fluid to cool the cutting blades of mill 30.

FIG. 1 shows the milling system prior to milling out an upper composite bridge plug 100. The bridge plug 100 includes slips 105 and a packing element 110. The slips 105 retain the bridge plug 100 at the set position within the casing 10, while the mill 30 begins to mill out the bridge plug 100. The packing element 110 is used to hydraulically isolate a portion of the casing 10. The bridge plug 100 is generally positioned below perforations 20 through the casing 10. The packing element 110 is expanded to hydraulically isolate the zone above the bridge plug 100 allowing the formation to be fractured at the perforations 20 with fracturing fluid. Fracturing fluid typically includes proppant 50, such as sand, which may be present within the casing 10 even after the fracturing process. The amount of proppant 50 present between the upper bridge plug 100 and a lower bridge plug 200 may depend upon various factors as discussed above. The pumping of fluid 15 down the coiled tubing 5 provides for the return of fluids and various solids up the annulus 60 between the coiled tubing 5 and the casing 10.

The bridge plug 100 includes an upper profile 150 and a lower profile 140. The lower profile is adapted to create a rotational lock with the upper profile 250 of the lower bridge plug 200. The lower bridge plug 200 also includes a lower profile 240 which may create a rotational lock with another bridge plug (not shown) located beneath the lower bridge plug 200. Various profiles may be used on the upper and lower surfaces of a bridge plug to create a rotational lock between two adjacent bridge plugs as would be appreciated by one of ordinary skill in the art having the benefit of this disclosure.

Figure 2:
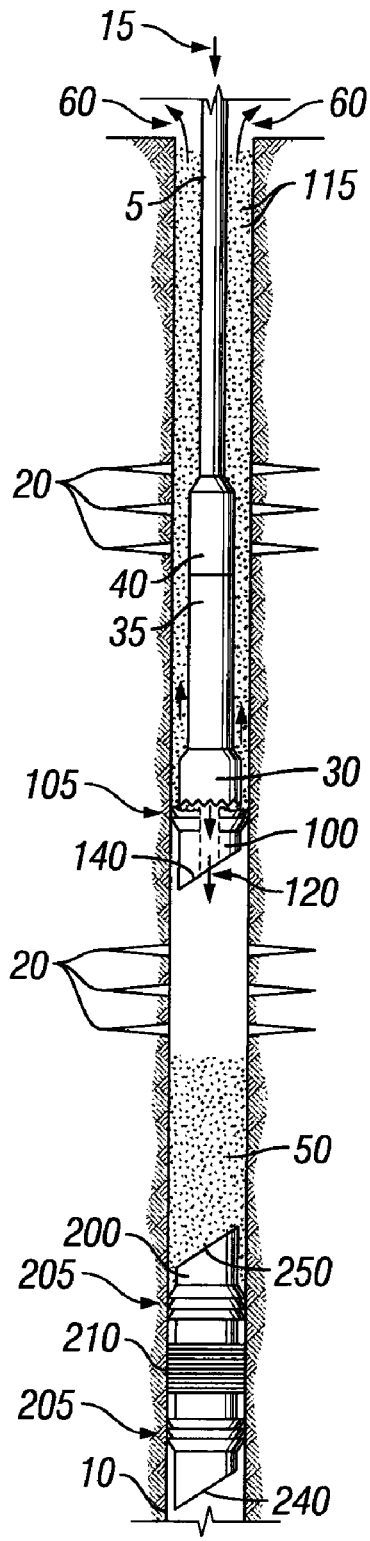
FIG. 2 shows the milling system of FIG. 1 milling through the top bridge plug with a lower portion still being retained within the wellbore by the slips.

FIG. 2 shows the milling system of FIG. 1 cutting through the top bridge plug 100 with the lower portion of the bridge plug 100 still being retained within the casing 10 by the lower set of slips 105. The bridge plug 100 includes a central opening or passageway 120 that allows fluid from the mill 30 to flow past the bridge plug 100 once the upper portion of the bridge plug 100 has been removed by the mill 30. The mill 30 includes a central port 25 (shown in FIG. 5) that is adapted to direct fluid 15 pumped down the coiled tubing 5 to pass through the central opening 120 of the bridge plug 100. As previously discussed, central port 25 is offset from the true center line of mill 30, thereby allowing some cutting structure of mill 30 to extend across the entire cross-sectional area of bridge plug 100. The degree of offset is such that fluid exiting port 25 is still communicated through opening 120 of plug 100. The other wash ports 45 (shown in FIG. 5) of mill 30 may circulate fluid within casing 10, the fluid returning proppant 50 and pieces 115 of bridge plug 100 to the surface, along annulus 60 between coiled tubing 5 and casing 10.

Figure 3:
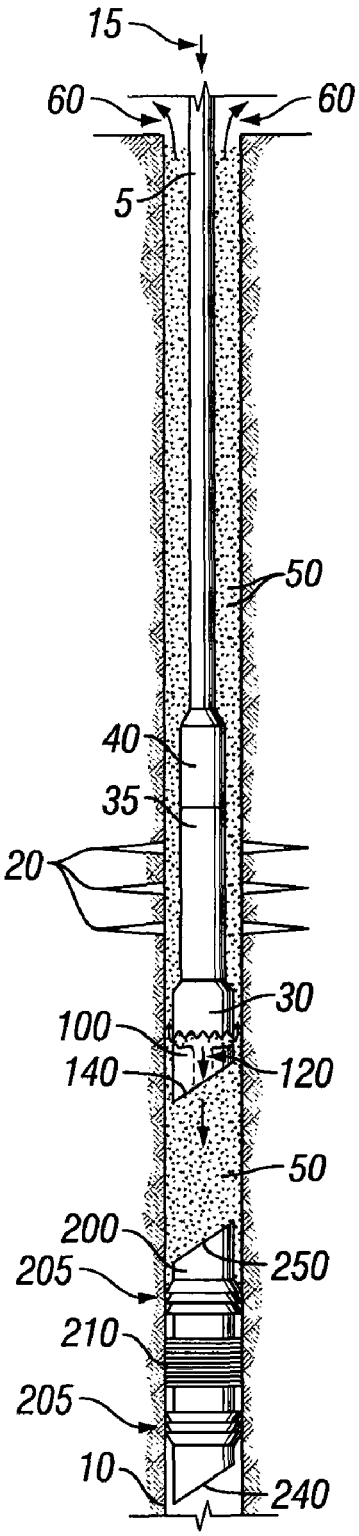
FIG. 3 shows the milling system of FIG. 1 fluidizing the proppant located below the bottom portion of the top bridge plug.

Once mill 30 has milled out the lower slips 105 of the upper bridge plug 100, the remaining portion of the upper bridge plug 100 will drop onto the proppant 50 that has settled on top of the lower bridge plug 200 as shown in FIG. 3. Because the upper bridge plug 100 rests on the proppant 50 and not the lower bridge plug 200, the upper bridge plug 100 is free to spin within the casing 10. The central port 25 of the mill 30 is designed to direct the fluid 15 pumped down the coiled tubing 5 through the central opening 120 of the remaining portion of the upper bridge plug 100. The fluid fluidizes the proppant 50 located on top of the lower bridge plug 200. The fluidized proppant 50 may then be circulated around the upper bridge plug 100 and up the annulus 60 between the coiled tubing 5 and the casing 10. The fluidizing of the proppant 50 permits the rapid removal of the proppant 50 that has settled on top of the lower plug 200.

Figure 4:
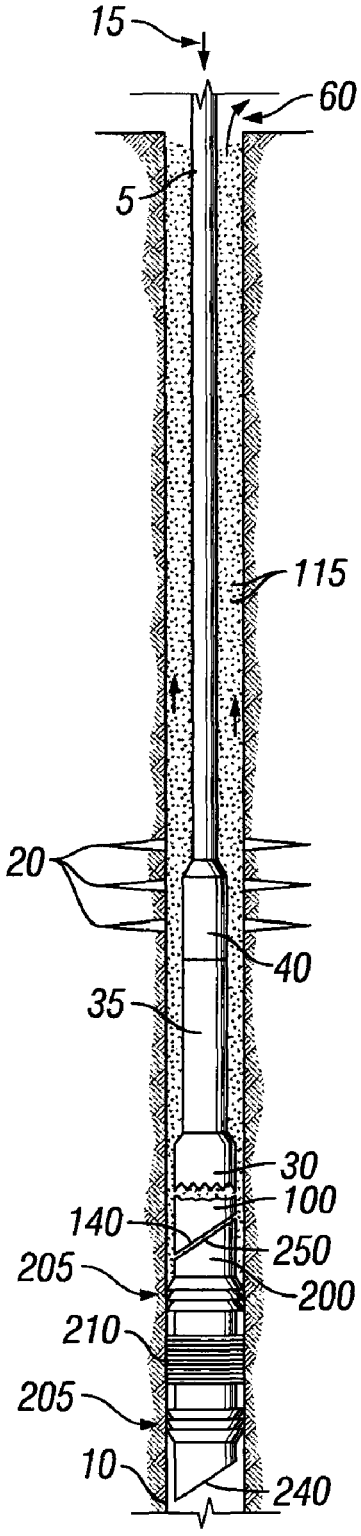
FIG. 4 shows the milling system of FIG. 1, the proppant below the top bridge plug having been removed, thereby allowing the bottom profile of top bridge plug to mate with the upper profile of a lower bridge plug, thereby preventing rotation of the top bridge plug.

Once the proppant 50 has been circulated from beneath the bridge plug 100, the lower profile 140 of the upper bridge plug 100 is able to mate with the upper profile 250 of the lower bridge plug 200 creating a non-rotational lock as shown in FIG. 4. This prevents the rotation of the upper bridge plug 100 with respect to the lower bridge plug 200, which permits the remaining portion of the bridge plug 100 to be milled out. The mill 30 can then begin milling out the lower bridge plug 200. The slips 205 of the lower bridge plug 200 prevent the rotation of the lower bridge plug 200 while it is being milled out. The packing element 210 of the lower bridge plug 200 may have been previously used to hydraulically isolate the zone located directly above the lower bridge plug 200. Once the lower slips 205 of the lower bridge plug 200 have been milled out, the lower bridge plug 200 will fall onto any proppant 50 that has settled on the next adjacent bridge plug. The process of removing a bridge plugs may then be repeated until each of the bridge plugs have been removed from the casing 10.

Figure 5:
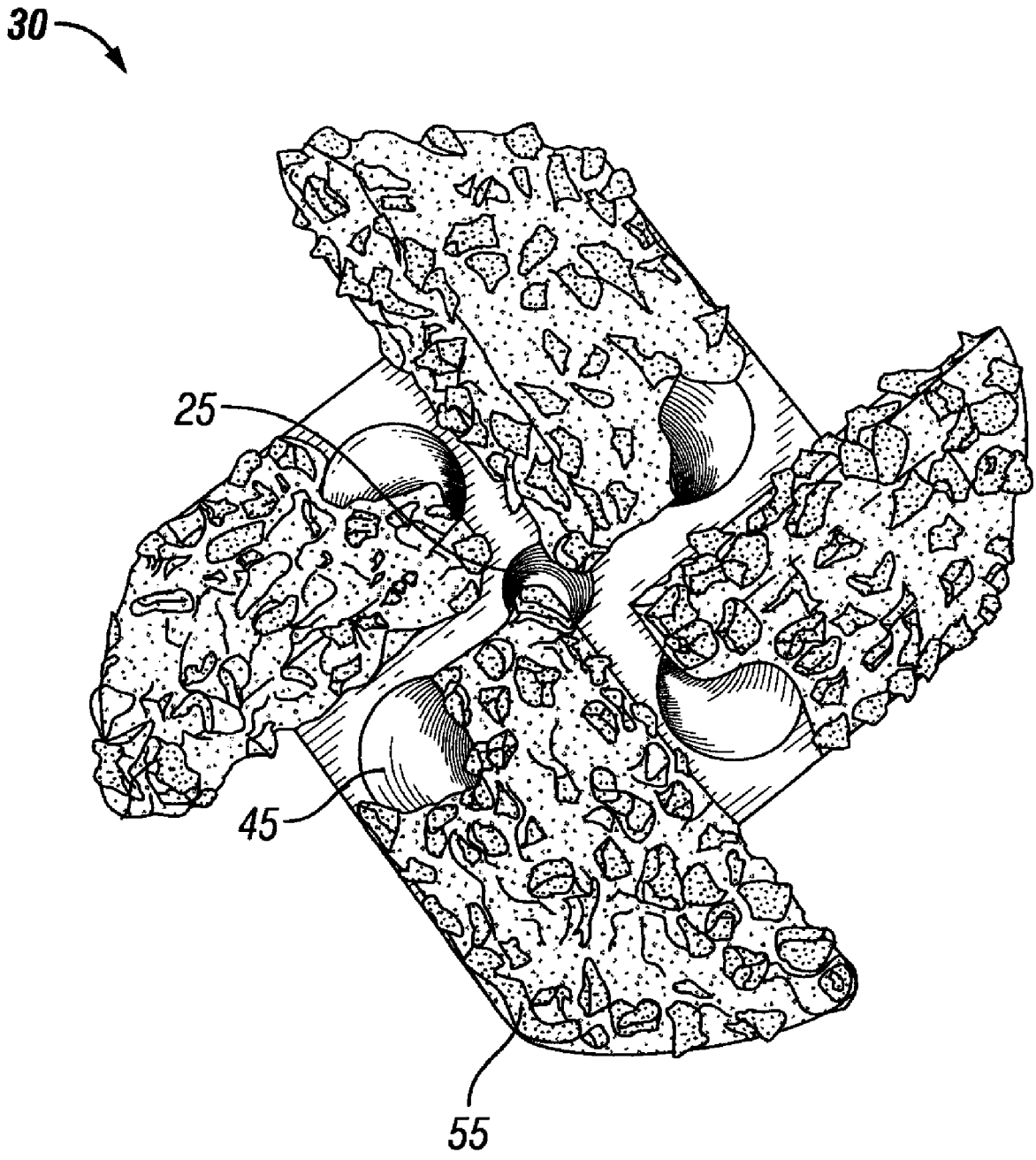
FIG. 5 shows one exemplary embodiment of a mill having a central port used to fluidize and circulate proppant located below a bridge plug.

FIG. 5 shows one exemplary embodiment of a mill 30 that may be used to rapidly remove settled proppant 50 from below a bridge plug. The mill 30 includes blades 55 used to mill through the bridge plug. The number and configuration of the four blades 55 is only shown for illustrative purposes. A various number and configurations of blades 55 may be used with the disclosed invention as would be appreciated by one of ordinary skill in the art having the benefit of this disclosure. For example, a five bladed mill may be used.

The mill 30 includes a plurality of wash ports 45 and a central port 25. The wash ports 45 provide cooling fluid across the cutting surfaces of the mill 30 and may also be used to help circulate the fluid above a bridge plug 100, returning suspended particles to the surface through the annulus 60 between the coiled tubing 5 and the casing 10. Also, since there is a practical limit to the total fluid flow through coiled tubing 5, it may be necessary to restrict the size of wash ports 45 so that the desired amount of flow through central port 25 is achieved. In the most preferred embodiment, for example, wash ports 45 are smaller than central port 25 such that 50% of the fluid flows through central port 25. The size, number, direction and location of the wash ports 45 may be varied in the use of the disclosed invention as would be appreciated by one of ordinary skill in the art having the benefit of this disclosure.

The mill 30 includes a central port 25 which is slightly offset from the true center line of mill 30. The central port 25 is adapted to direct fluid 15 being pumped down the coiled tubing 5 through a central opening 120 within a partially milled out bridge plug 100. The degree of offset, however, is small enough to still allow fluid exiting port 25 to flow directly through opening 120 of plug 100. This fluid 15 is then used to fluidize settled proppant 50 that is located below the partially milled out bridge plug 100. The fluidized proppant 50 is circulated around the perimeter of the bridge plug 100 and returned to the surface through the annulus 60 between the coiled tubing 5 and the casing 10.

The amount of fluid and configuration of the central port 25 of the mill 30 may be varied to efficiently fluidize and remove settled proppant 50 below a partially milled out bridge plug 100. In the most preferred embodiment, fluid 15 may be jetted at a rate of at least 17 gallons per minute through central port 25. Such fluid rates, for example, may be between 40 and 80 gallons per minute. The rate at which the proppant 50 is circulated away from beneath the plug 100 may increase as the flow of fluid from the central port 25 increases.

Figure 6:
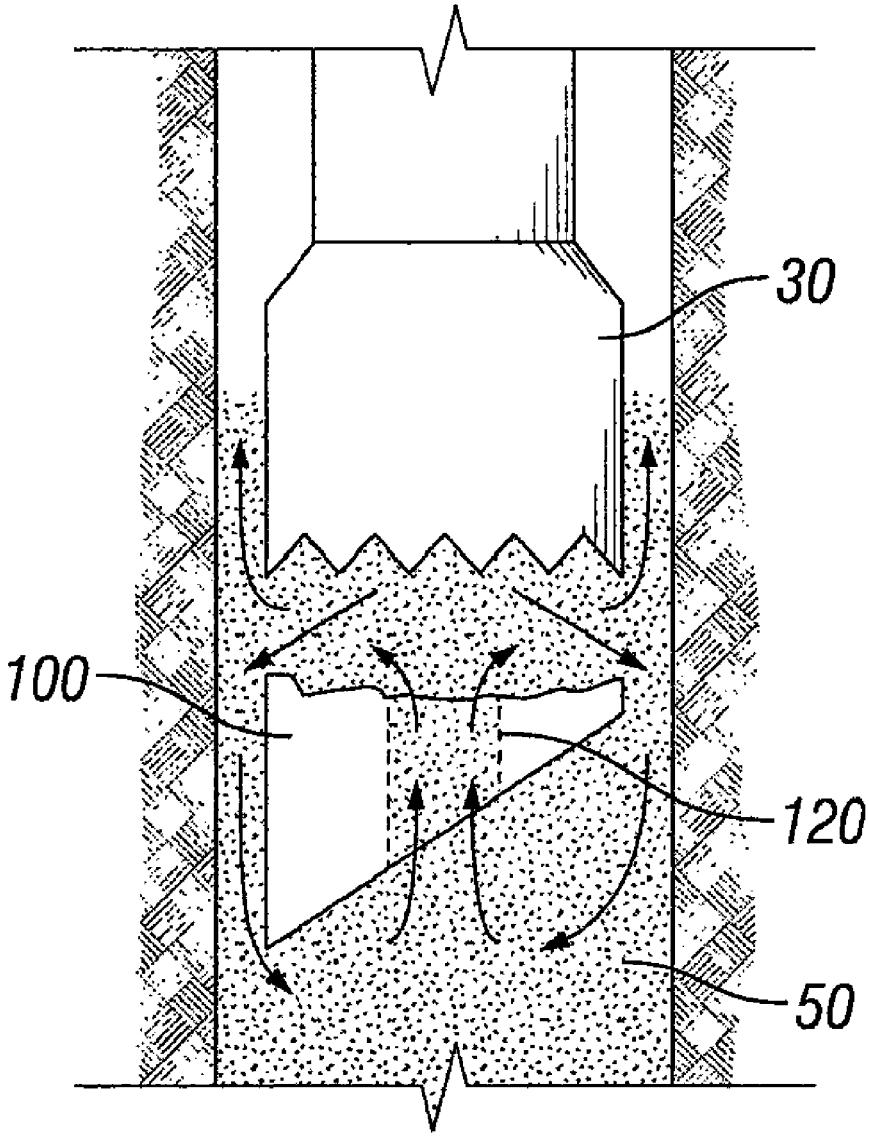
FIG. 6 illustrates the milling system according to an alternative exemplary embodiment of the present invention whereby reverse flow is conducted.

In the alternate embodiment of FIG. 6, mill 30 may be designed to generate a reverse flow around the bridge plug 100 to remove proppant 50 located below the plug 100. The proppant 50 is fluidized and circulated up the central opening 120 located in the bridge plug 100. In this embodiment, mill 30 would not include central port 25 therein. Instead, wash ports 45 are angled and forward facing (in the direction of the mill's rotation). In operation, wash ports 45 direct fluid downwards around the outside of plug 100 which has been milled out such that it is no longer set in the wellbore. The fluid is then allowed to return back up central opening 120 of plug 100, through flow channels around the face of mill 30, and up the annular area between mill 30 and casing 10. The fluidized proppant 50 may then be returned to the surface through the annulus 60 between the coiled tubing 5 and the casing 10.

In addition, the configuration of the bridge plug 100 may be adapted to improve the circulation flow currents due to the fluid jetted from the end of the mill 30. For example, central opening 120 could be enlarged to allow fluid to more easily flow under reverse flow conditions. The improved circulation flow currents may increase the rate at which the proppant 50 may be removed from beneath the bridge plug 100.

Although various embodiments have been shown and described, the invention is not so limited and will be understood to include all such modifications and variations as would be apparent to one skilled in the art, as well as related methods. Accordingly, the present invention is not to be restricted except in light of the attached claims and their equivalents.

What is claimed is:

1. A system for the removal of plugs from a wellbore, the system comprising:

a motor connected to an end of a coiled tubing; and a mill having a bladed cutting structure, the mill being connected to the motor, the mill comprising at least three wash ports and a central port being in fluid communication with the coiled tubing, the central port being adapted to communicate fluid directly through an opening in a plug, thereby allowing the fluid to circulate proppant up past the plug in order to facilitate removal of the plug;

wherein the central port of the mill and the wash ports are adapted such that at least 30% of the fluid flows through the central port and is configured to produce a rate at which the proppant circulates up past the plug that is greater than a rate exhibited if less than 30% of the fluid flows through the central port and wherein the central port is offset from a true center-line of the mill, but within a degree of offset from the true center-line still allowing the fluid, communicated through the central port to flow directly through the opening in the plug, the cutting structure extending across the center-line of the mill.

2. A system as defined in claim 1, wherein the central port of the mill is adapted to jet the fluid through the opening in the plug at a rate of at least 17 gallons per minute.

3. A system as defined in claim 1, wherein the plug comprises an upper profile and lower profile, the upper and lower profiles being adapted to create a rotational lock between the plug and an adjacent plug.

4. A system as defined in claim 1, wherein the central port of the mill communicates at least 50% of the fluid.

5. A system as defined in claim 1, wherein the mill comprises at least four wash ports.

6. A system as defined in claim 5, wherein the central port of the mill and the wash ports are adapted such that at least 50% of the fluid flows through the central port.

7. A method for the removal of plugs from a wellbore, the method comprising the steps of:

(a) running a mill into the wellbore on a downhole motor attached to an end of a coiled tubing, the mill comprising at least three wash ports and a central port being in fluid communication with the coiled tubing;

(b) pumping fluid down the coiled tubing and through the wash ports and the central port of the mill;

(c) milling out an upper plug until the upper plug is no longer set within the wellbore;

(d) pumping fluid through the central port of the mill and directly through an opening in the upper plug, the fluid being pumped through the central port comprising at least 30% of a total amount of fluid being pumped down the coiled tubing;

(e) circulating proppant located below the upper plug up the wellbore until a lower surface of the upper plug engages a top surface of a lower plug set in the wellbore, a rate at which the proppant circulates away from the lower plug being greater than a rate exhibited if less than 30% of the total amount of fluid is pumped through the central port; and (f) milling out the lower surface of the upper plug and the lower plug until the lower plug is no longer set in the wellbore.

8. A method as defined in claim 7, wherein step (b) further comprises the step of displacing proppant located below the mill until the mill engages the upper plug.

9. A method as defined in claim 7, the method further comprising the step of preventing rotation between the lower surface of the upper plug and an upper surface of the lower plug after the proppant located below the upper plug has been displaced past the upper plug.

10. A method as defined in claim 7, wherein step (e) further comprises the steps of:

circulating the proppant located below the upper plug around a perimeter of the upper plug; and pumping the proppant out of the wellbore, the proppant flowing through an annulus between the coiled tubing and a casing of the wellbore.

11. A method as defined in claim 7, wherein the fluid being pumped through the central port comprises at least 50% of the fluid being pumped down the coiled tubing.

12. A method as defined in claim 7, wherein the mill comprises at least four wash ports and has a bladed cutting structure.

13. A method as defined in claim 12, wherein the fluid being pumped through the central port comprises at least 50% of a total amount of fluid being pumped down the coiled tubing.

14. A method as defined in claim 7, wherein the mill has a bladed cutting structure and the central port is offset from a true center-line of the mill, but within a degree of offset from the true center-line still allowing the fluid pumped through the central port to flow directly through the opening in the upper plug, the cutting structure extending across the center-line of the mill.

15. A method of removing proppant below an unset plug in a wellbore, the method comprising the steps of:

(a) circulating fluid through a central port in a mill having a bladed cutting structure and circulating fluid through a central opening in the unset plug, the fluid being pumped through the central port in the mill comprising at least 30% of a total amount of fluid being pumped down the wellbore, wherein the central port in the mill is offset from a true center-line of the mill within a degree of offset from the true center-line allowing the fluid circulated through the central port to flow directly through the central opening in the unset plug, the cutting structure extending across the center-line of the mill;

(b) fluidizing the proppant beneath the unset plug by using the fluid circulated through the central port in the mill that flows directly through the central opening in the unset plug;

(c) displacing the fluidized proppant up an annular space between the unset plug and the wellbore; and (d) displacing the fluidized proppant out of the well.

16. A method as defined in claim 15, wherein the fluid being pumped through the central port in the mill comprises at least 50% of the fluid being pumped down the wellbore.

17. A method as defined in claim 15 further comprising pumping fluid through at least three wash ports.

18. A method as defined in claim 17, wherein the wash ports and central port are adapted such that fluid being pumped through the central port of the mill comprises at least 50% of the total amount of fluid being pumped down the wellbore.

* * * * *